US011905703B2

(12) United States Patent
Sheng et al.

(10) Patent No.: US 11,905,703 B2
(45) Date of Patent: Feb. 20, 2024

(54) SOFT ACOUSTIC BOUNDARY PLATE

(71) Applicant: THE HONG KONG UNIVERSITY OF SCIENCE AND TECHNOLOGY, Hong Kong (CN)

(72) Inventors: Ping Sheng, Hong Kong (CN); Ho Yiu Mak, Hong Kong (CN); Xiaonan Zhang, Hong Kong (CN); Zhen Dong, Hong Kong (CN)

(73) Assignee: THE HONG KONG UNIVERSITY OF SCIENCE AND TECHNOLOGY, Hong Kong (CN)

( * ) Notice: Subject to any disclaimer, the term of this patent is extended or adjusted under 35 U.S.C. 154(b) by 294 days.

(21) Appl. No.: 17/290,624

(22) PCT Filed: Dec. 23, 2019

(86) PCT No.: PCT/CN2019/127482
§ 371 (c)(1),
(2) Date: Apr. 30, 2021

(87) PCT Pub. No.: WO2020/125799
PCT Pub. Date: Jun. 25, 2020

(65) Prior Publication Data

US 2021/0381231 A1 Dec. 9, 2021

Related U.S. Application Data

(60) Provisional application No. 62/937,512, filed on Nov. 19, 2019, provisional application No. 62/917,643, filed on Dec. 21, 2018.

(51) Int. Cl.
*E04B 1/82* (2006.01)
*E04B 1/84* (2006.01)

(52) U.S. Cl.
CPC ..... *E04B 1/8209* (2013.01); *E04B 1/84* (2013.01); *E04B 2001/8428* (2013.01)

(58) Field of Classification Search
CPC ..... E04B 1/8209; E04B 2001/8263; E04B 2001/8272; E04B 2001/8281;
(Continued)

(56) References Cited

U.S. PATENT DOCUMENTS 2,153,357 A * 4/1939 Wente ..... G10K 11/16 181/291
3,857,459 A * 12/1974 Adams ..... E04B 1/8209 181/295
(Continued)

FOREIGN PATENT DOCUMENTS

CN 1193248 A 9/1998
CN 102904061 A * 1/2013
(Continued)

OTHER PUBLICATIONS

English transaltion for JP-2004232357-A, accessed Apr. 14, 2023 via USPTO search tool (Year: 2004).*

*Primary Examiner* — Jeremy A Luks
(74) *Attorney, Agent, or Firm* — Nath, Goldberg & Meyer; Jerald L. Meyer

(57) ABSTRACT

A soft boundary structure is implemented using a resonator structure capable of receiving sound or vibration, establishing resonance coupled with received sound or vibration, and creating a reflection with a pi phase factor. A soft boundary is located on or closely adjacent the resonator structure. The soft boundary cooperates with the resonator structure to attenuate the sound or vibration.

26 Claims, 11 Drawing Sheets

(58) Field of Classification Search
CPC ..... E04B 2001/829; E04B 1/84; E04B 1/99; E04B 2001/8428; E04B 2001/8433
See application file for complete search history.

(56) References Cited

U.S. PATENT DOCUMENTS

| | | | | | |
|---|---|---|---|---|---|
| 4,244,439 | A * | 1/1981 | Wested | E01F 8/0035 | 181/292 |
| 5,780,785 | A * | 7/1998 | Eckel | E04B 1/84 | 181/295 |
| 6,035,965 | A * | 3/2000 | Fujiwara | G10K 11/16 | 181/295 |
| 6,371,240 | B1 * | 4/2002 | Hayes | G10K 11/16 | 181/295 |
| 8,573,356 | B1 * | 11/2013 | Perdue | G10K 11/20 | 181/295 |
| 11,322,126 | B2 * | 5/2022 | Lee | G10K 11/172 | |
| 2007/0034448 | A1 * | 2/2007 | D'Antonio | E04B 1/86 | 181/293 |
| 2018/0010334 | A1 * | 1/2018 | Perdue | E04B 1/8209 | |
| 2019/0206380 | A1 * | 7/2019 | Hakuta | G10K 11/162 | |

FOREIGN PATENT DOCUMENTS

| | | | | | |
|---|---|---|---|---|---|
| CN | 202672391 | U | | 1/2013 | |
| CN | 202806619 | U | | 3/2013 | |
| CN | 106703234 | A | * | 5/2017 | |
| CN | 107119811 | A | * | 9/2017 | E04B 1/84 |
| CN | 206844366 | U | | 1/2018 | |
| EP | 2402936 | B1 | * | 12/2016 | E04B 1/86 |
| JP | 2004232357 | A | * | 8/2004 | |
| WO | WO-2006119964 | A2 | * | 11/2006 | E04B 9/366 |
| WO | 2018047153 | A1 | | 3/2018 | |

* cited by examiner

SOFT ACOUSTIC BOUNDARY PLATE

RELATED APPLICATIONS

The present patent application claims priority to U.S. Provisional Patent Application No. 62/917,643 filed Dec. 21, 2018, and U.S. Provisional Patent Application No. 62/937,512 filed Nov. 19, 2019, which are assigned to the assignee hereof and filed by the inventors hereof and which is incorporated by reference herein.

BACKGROUND

Technical Field

This disclosure relates to sound attenuation using soft boundaries to increase attenuation. More particularly, the disclosure relates to establishing a soft boundary through sidewall resonators and through "extinction" of the sound through scattering to the 90° direction from the incident direction combined with sound absorption or diminished reflection.

Background Art

At normal incidence, reflection coefficient R from a flat sample is given by $$R = \frac{Z - Z_0}{Z + Z_0}, \tag{1}$$

where $Z=\rho v$ denotes the sample impedance, $\rho$ denotes the mass density, v is the sound speed, $Z_0=\rho_0 v_0$ is the impedance of air, $v_0=340$ m/sec being the speed of airborne sound, and $\rho_0=1.225$ kg/m$^3$ being the air density.

If the sample sits on a reflecting hard surface, then there is no transmission, and absorption is described by:

$$A=1-|R|^2$$

In particular, if the sample is impedance-matched to air; i.e., $Z=Z_0$, then total absorption can be achieved.

Most solid boundaries have impedance much larger than that of air; i.e., $Z>>Z_0$. Hence, as seen in Equation (1) the reflection coefficient is positive and nearly unity in magnitude; i.e., velocity field of sound forms a node at the wall. This is denoted the hard boundary condition. One can easily see from Equation (1) that if $Z<Z_0$, then the reflection coefficient becomes negative; i.e., there is a phase shift when that occurs. In that case, instead of having a node, the velocity amplitude would remain finite at such an impedance boundary condition. This boundary condition can be described as a "soft" wall boundary condition. Both the soft and hard boundary conditions imply total reflection, with zero absorption.

SUMMARY

A soft boundary structure comprises a resonator structure capable of receiving sound or vibration, establishing resonances coupled with received sound or vibration, and creating a reflection with a pi phase factor. A soft boundary is established on or closely adjacent the resonator structure, and cooperates with the resonator structure to attenuate the sound or vibration.

In one configuration, the resonator structure comprises sidewall resonators. The sidewall resonators achieve sound extinction through scattering to a different direction from an incident direction through absorption and/or scattering effects. The sidewall resonators may be configured so that they achieve sound extinction through scattering substantially 90° from an incident direction through absorption and/or scattering effects.

In another configuration, the resonator structure has a restricted top plate, a plurality of open sidewalls and a restricted backwall, which are configured to create an area change by using the open sidewalls. The open sidewalls cause incident sound waves engaging the structure to turn and pass at least a subset of the plurality of sidewalls. Incident sound waves encounter an increase of cross-sectional area, which results in a soft boundary condition. The open sidewalls cause incident sound waves engaging the structure to turn and pass at least a subset of the plurality of sidewalls. Incident sound waves encounter an increase of cross-sectional area, which results in a soft boundary condition. The structure causes the incident sound waves to turn, resulting in an extinction effect to reduce reflected sound.

BRIEF DESCRIPTION OF THE DRAWINGS

FIG. 4A shows pressure from a dipolar source. FIG. 4B shows velocity from a dipolar source. FIG. 4C shows pressure from a monopolar source. FIG. 4D shows velocity from a monopolar source.

FIG. 5A is a schematic depiction of a change in a back tube. FIG. 5B is a schematic depiction of a change in the cross-sectional area of the sidewall. FIG. 5C is a graphic result showing simulation results on the real part of the reflection coefficient with different area change.

FIG. 7A shows hybrid membrane resonators. FIG. 7B shows spring mass resonators. FIG. 7C shows flexural resonators.

FIG. 8A shows the results for a unit with a single large sidewall cavity. FIG. 8B shows the results for a unit with two large sidewall cavities. FIG. 8C shows the results for a unit with a single smaller sidewall cavity. FIG. 8D shows the results for a unit with two smaller sidewall cavities.

FIG. 9A is a schematic diagram of a 4 by 4 boundary plate used in the simulation. FIG. 9B is the graphic depiction showing absorption vs. frequency.

FIG. 10A is an image of a resonator. FIG. 10B is a graphic representation of the reflection coefficient at different frequencies when one resonator is mounted on the sidewalls. FIG. 10C is a graphic representation of the reflection coefficient at different frequencies when three resonators are mounted on the sidewalls.

FIGS. 12A-12C are photo image of a single unit (FIG. 12A) and bottom and top views of 4 by 4 plate (FIGS. 12B and 12C, respectively). FIGS. 12D and 12E are graphic depiction of soft plate samples.

DETAILED DESCRIPTION

Overview

A sound barrier uses a soft acoustic boundary plate for sound absorption. This provides the desired sound absorption and also creates a new audio experience in room acoustics, as well as amplifying dipolar sound sources.

For airborne sound, a soft boundary plate can be effected by two means:

(1) through sidewall resonators, which can be effective at particular or some discrete frequencies, and (2) through "extinction" of the sound through scattering to the 90° direction from the incident direction, connecting to an open area.

In the first configuration, the soft boundary condition is effected by the resonators at or close to its resonance frequency. The soft boundary condition for the second configuration, depending on the wavelength, is located preferably within or around one-fourth of a wavelength away from the junction that is connected to the open space.

Here the term "extinction" is used to mean diminished reflection, through both absorption and scattering effects. The result is attenuation of the sound or vibration. As used herein, extinction is the attenuation of sound or vibration that can occur by means of diminished reflection. The extinction resulting from diminished reflection is the result of the sound-absorbing material, such as an acoustic sponge, placed on top of a soft boundary plate. The acoustic sponge can be of any convenient sound absorbing or sound attenuating material. Typically, an acoustic sponge comprises porous reticulated sound absorbing material, which may be elastic or may rely on elasticity of entrained air or gas. Without the acoustic sponge, there will be a much higher reflection than observed when the acoustic sponge is used. The extinction effect, meaning diminished reflection, can be characterized to be a synergistic effect in combining an absorber, such as a sponge, with the soft boundary plate.

Sidewall resonators can be effective at particular or some discrete frequencies through extinction of the sound through scattering to the 90° direction. While a 90° direction is described, it is understood that this is an approximation, as the effect of extinction is achieved at angles other than 90°. If the direction is substantially 90° from the incident angle, then reflected (scattered) or resonated sound would not have a tendency to propagate back in the direction of incidence in a reverse direction. The function is that of reflecting or resonating sound in a direction that reduces the tendency of the reflected or resonated sound being re-transmitted back in the incident direction.

Soft Boundary Condition

Figure 1A:
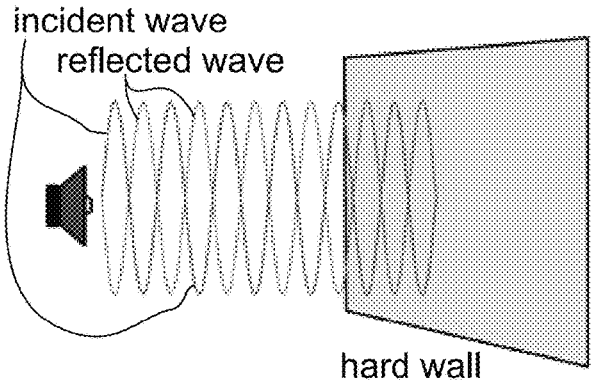
FIGS. 1A and 1B are schematic diagrams showing incident and reflective waves from a hard boundary wall (FIG. 1A) and a soft boundary wall (FIG. 1B).
Figure 1B:
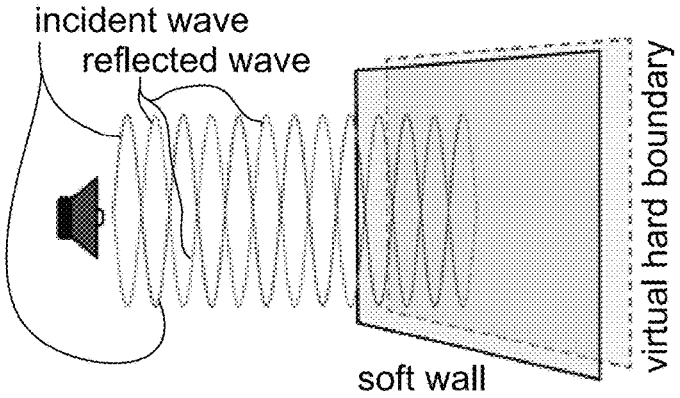

FIGS. 1A and 1B are schematic diagrams showing incident and reflective waves from a hard boundary wall (FIG. 1A) and a soft boundary wall (FIG. 1B). The reflection phase is the same for a (virtual) hard boundary wall placed one quarter of a wavelength beyond the soft boundary wall.

A soft boundary condition, with an anti-node at the wall would be equivalent to a hard wall beyond the location of the soft wall. This is the circumstance illustrated in FIGS. 1A and 1B. It follows that by having a soft boundary wall, one can make the audio experience to resemble a room larger than it actually is. From FIG. 1B one can also see that depending on the sound frequency, the "virtual room" is larger for lower frequencies than that for the high frequencies.

Figure 2A:
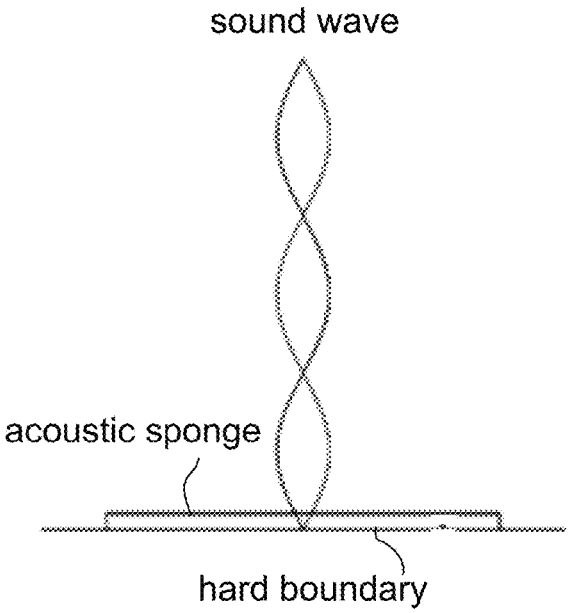
FIGS. 2A and 2B are schematic diagrams showing sound reflection within a thin layer of acoustic sponge placed on a hard wall boundary (FIG. 2A) and a soft wall boundary (FIG. 2B).
Figure 2B:
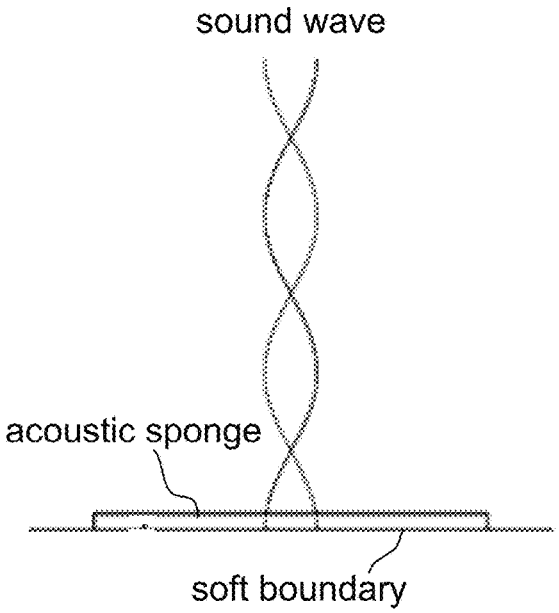
Figure 3A:
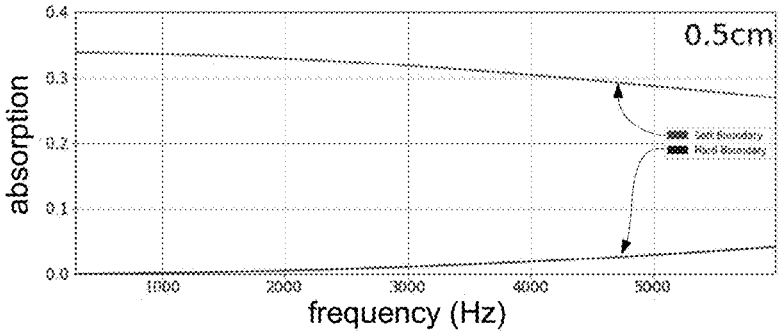
FIGS. 3A-3E are graphic depictions of simulation results on sound absorption by a thin layer of acoustic sponge placed on a hard boundary as compared to that placed on a soft boundary. The different charts are taken at different thicknesses of the sponge.
Figure 3B:
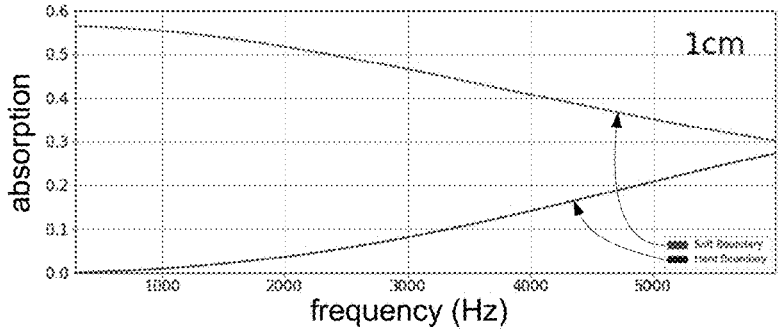
Figure 3C:
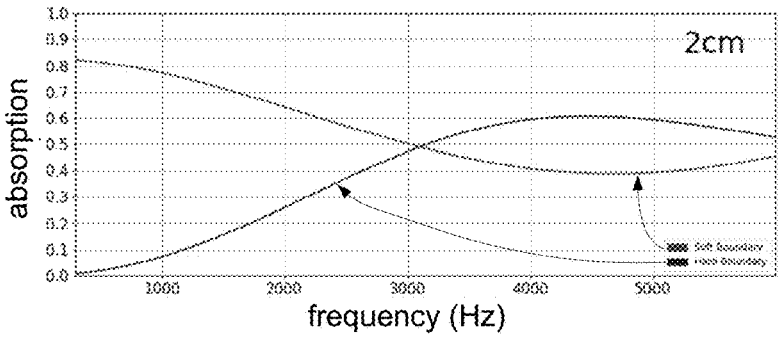
Figure 3D:
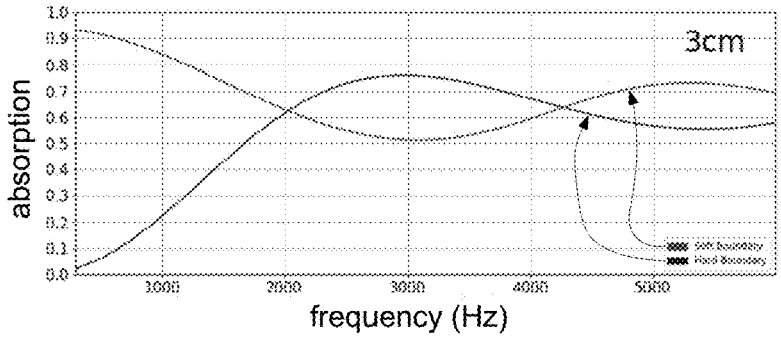
Figure 3E:
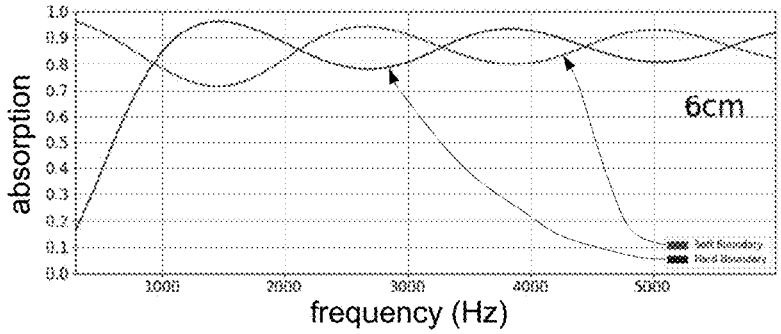

FIGS. 2A and 2B are schematic diagrams showing sound reflection within a thin layer of acoustic sponge placed on a hard wall boundary (FIG. 2A) and a soft wall boundary (FIG. 2B).

A second useful application of the soft boundary is that even though soft boundary itself implies zero absorption, it can greatly enhance the low frequency absorption of a thin layer of acoustic absorptive material like the acoustic sponge. The reason why is illustrated in FIGS. 2A and 2B. It is known that the total absorption of a sample is given by:

$$A=\int dV(\varepsilon\times\alpha) \tag{2}$$

where $\varepsilon$ denotes the energy density, and $\alpha$ denotes the absorption coefficient For a thin layer of acoustic sponge placed on a hard reflective boundary (with $Z>>Z_0$), the effect is as depicted in FIG. 2A. As illustrated in FIG. 2A, the amplitude of the acoustic wave inside the sponge is small for low frequency waves. This is because the sound amplitude has to grow from zero at the hard boundary (since there is a node at the boundary) to something appreciable, and for low frequency waves that might require a length scale that is larger than the sponge layer thickness. Hence the energy density (which is proportional to the square of the amplitude) must be small inside the thin layer, leading to a small total absorption at low frequencies.

In contrast, in FIG. 2B, the effect of a soft boundary is seen, which implies that there is an anti-node at the boundary. The amplitude inside the thin layer would be almost uniformly large for the low frequency waves, since it would take a length scale larger than the layer thickness for the amplitude to decrease appreciably. That is, the amplitude behavior is just the opposite as compared to a hard boundary, and a much larger absorption is the consequence.

FIGS. 3A-3E are graphic depictions of simulation results on sound absorption by a thin layer of acoustic sponge placed on a hard boundary, depicted by the curves which start on the bottom left of the respective charts in each graph as compared to that placed on a soft boundary, with Z=0 and R=−1 over the frequency range of 300-6000 Hz. The different charts are taken at different thicknesses of the sponge. The absorption of the sponge placed on a hard boundary appears is represented by the curves which start on the bottom left of the respective charts, and the absorption of the sponge placed on the soft boundary are represented by the curves which start on the top left of the respective charts. It is seen that the soft boundary is most effective at low frequencies.

From FIGS. 3A-3E, the effect of the soft boundary on the absorption of a thin layer of acoustic sponge, for the frequency range of 300 to 6000 Hz can be seen. The material parameter values for the acoustic sponge are given in the caption.

In many practical cases where only good absorption of low frequency is needed, the soft acoustic boundary plate can be an indispensable choice with no alternative structures. Moreover, owing to the fact that a soft boundary implies no absorption, from the causality constraint, the theoretical minimum thickness for the soft acoustic boundary plate can approach zero. As will be seen, it is possible to approach this limit.

A third use of the soft acoustic boundary is amplifying a dipolar acoustic source placed close to the boundary through constructive interference, while dimming a monopolar source placed close to the boundary through destructive interference.

If the boundary is hard, it necessarily imposes a nodal boundary condition and the reflected wave has to be opposite in phase to the forward propagating wave away from the boundary. That would imply destructive interference. In contrast, for a soft boundary the opposite is true, and that implies constructive interference of the reflected and forward propagating waves.

The phase difference between the reflection coefficient of a hard boundary(hard wall) and a soft boundary(soft boundary plate) can be referred to as a "pi phase factor". The pi phase factor can be expressed as a reflection coefficient, which can be a complex number. For an ideal hard boundary, the real and imaginary part of the reflection coefficient are 1 and 0. For an ideal soft boundary condition, the real and imaginary part of the reflection coefficient can be −1 and 0. The difference in the complex reflection coefficient corresponds to a pi phase difference.

Figure 4A:
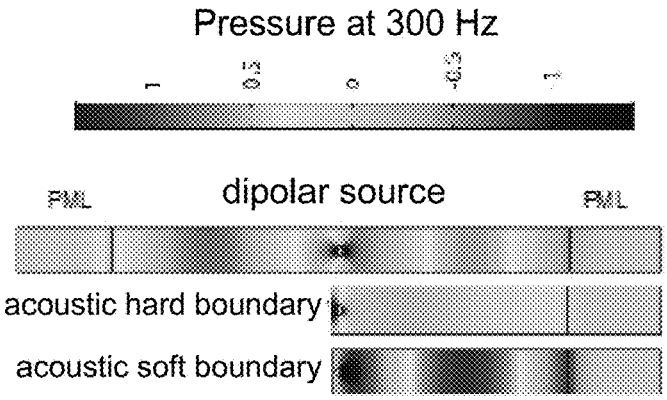
FIGS. 4A-4D are spectrographs showing pressure and velocity from dipolar sources and monopolar sources, taken at 300 Hz, showing the effect of a hard boundary and soft boundary on monopole and dipolar sources.
Figure 4B:
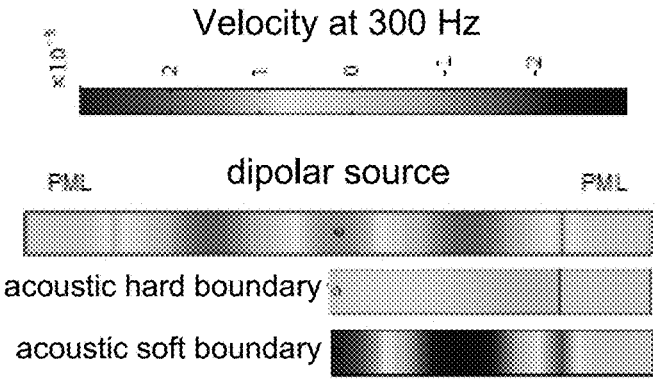
Figure 4C:
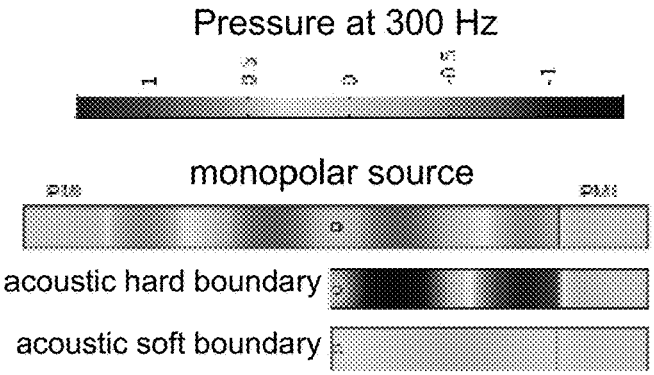
Figure 4D:
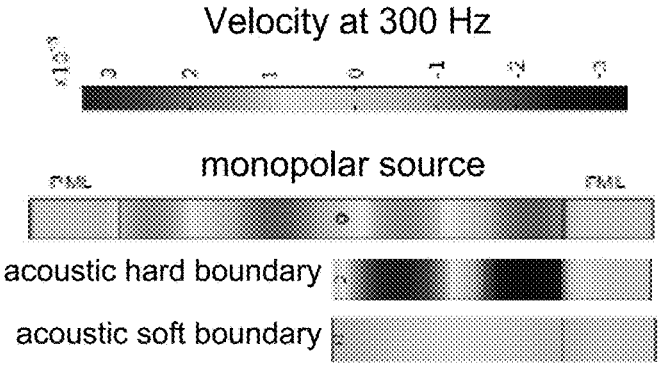

FIGS. 4A-4D is showing the effect of the soft boundary on a monopole and dipolar source. FIGS. 4A-4D are spectrographs showing pressure and velocity from dipolar sources and monopolar sources, taken at 300 Hz, showing the effect of a hard boundary and soft boundary on monopole and dipolar sources. FIG. 4A shows pressure from a dipolar source. FIG. 4B shows velocity from a dipolar source. FIG. 4C shows pressure from a monopolar source. FIG. 4D shows velocity from a monopolar source.

"Dipolar source" refers to a source that generates signal in opposite directions with a pi phase factor. For simplicity, consider a one-dimensional case. In the one-dimensional case, the dipolar source would be generating signals propagating in left and right direction with equal magnitude but in opposite sign. Functionally, a soft boundary placed close to the dipolar source is that it can reflect a travelling wave on the one of the left or right side so that the reflected travelling wave is in phase with the opposite side (right or left, respectively).

Thus (still applying the one-dimensional case), a soft boundary placed close to the dipolar source can reflect the left travelling wave so that the reflected wave is in phase with the right travelling wave. (Conversely, the soft boundary placed close to the dipolar source can reflect the right travelling wave so that the reflected wave is in phase with the left travelling wave.) In such case, constructive interference between the reflected and original right travelling wave occurs, so that the right travelling wave would be amplified, and constructive interference between the reflected and original left travelling wave occurs, so that the left travelling wave would be amplified.

The pressure and velocity are advantageous when amplifying sound from dipolar sources. The configuration requires no amplified sound source. By placing a normal dipolar sound source close to the soft wall, constructive interference would occur between the reflected and the original sound source, which would result in an amplified sound wave. The sound absorbing structure receives sound or vibration from a dipolar source, by achieving sound reflection through the resonators and the soft boundary, and provides improved sound optics for a room or other environment. The structure further provides an ability to enhance sound from an externally-generated sound source. Alternatively, the sound absorbing structure receives sound or vibration from a dipolar source, by achieving sound absorption through the resonators and the soft boundary and provides improved sound optics for a room or other environment, while also providing a capability of enhancing sound from a dipolar sound source.

Design of Broadband Soft Acoustic Boundary

To be useful, the soft boundary must be broadband in character. This involves the integration of many resonators so as to form a consistent soft boundary behavior. In the present case, we would like to focus on the audible regime of 100-1,500 Hz. Above 1,500 Hz, the above two uses of the soft boundary would have less advantages, owing to the short wavelength involved.

The soft boundary must be mass-producible at low cost in order to achieve large-scale commercial applications. This is implemented with a design strategy for the soft boundary with such properties. The acoustic soft boundary is achievable by using resonances. Since each resonance is a narrow frequency band in character, to attain broadband characteristics one must integrate multiple resonators in accordance with an algorithm that has proven to be very successful. In the idealized case of having available a continuum of resonances, the optimal choice of resonance frequencies for achieving the target impedance spectrum Z(f) is shown to satisfy a simple differential equation given by:

$$\frac{df}{d\bar{n}} = 2\phi\frac{Z(f)}{Z_0}f, \tag{2}$$

where $\phi$ is the fraction of surface area occupied by the resonators, and $\bar{n}$ is a continuous linear index of the frequency, ranging from 0 to the maximum number of resonators to be used in the design.

In order to design the soft boundary, one would choose $Z(f)/Z_0=\varepsilon$, where $\varepsilon\approx 0$ is a small constant. One could make the approximation $\phi=1$. Then solution to Equation (2) is given by:

$$f_1=f_c\exp(2\varepsilon\bar{n})\approx f_c(1+2\varepsilon)$$

since the solution should be valid only in the neighborhood of $f_c$.

It follows that $f_2=f_1(1+2\varepsilon)=f_c(1+2\varepsilon)^2$, and $f_n=f_c(1+2\varepsilon)^n$.

If $f_{100}=f_c(1+2\varepsilon)^{25}=1500$ Hz and $f_c=300$ Hz, then this results in $\varepsilon=0.0332$, and therefore:

$$f_n=300(112\times 0.0332)^n \text{ Hz}. \tag{3}$$

From the above, it can be seen that in order to achieve, the number of resonators required would approach. In the present case a design configuration comprising 25 resonators is chosen.

Figure 5A:
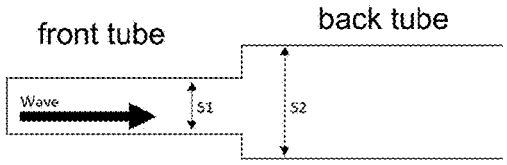
FIGS. 5A-5C show a simulation from a change in cross-section of a tube.
Figure 5B:
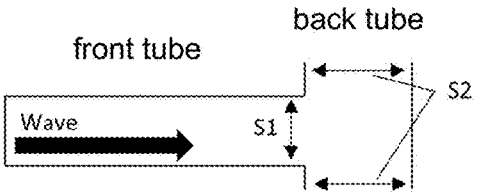
Figure 5C:
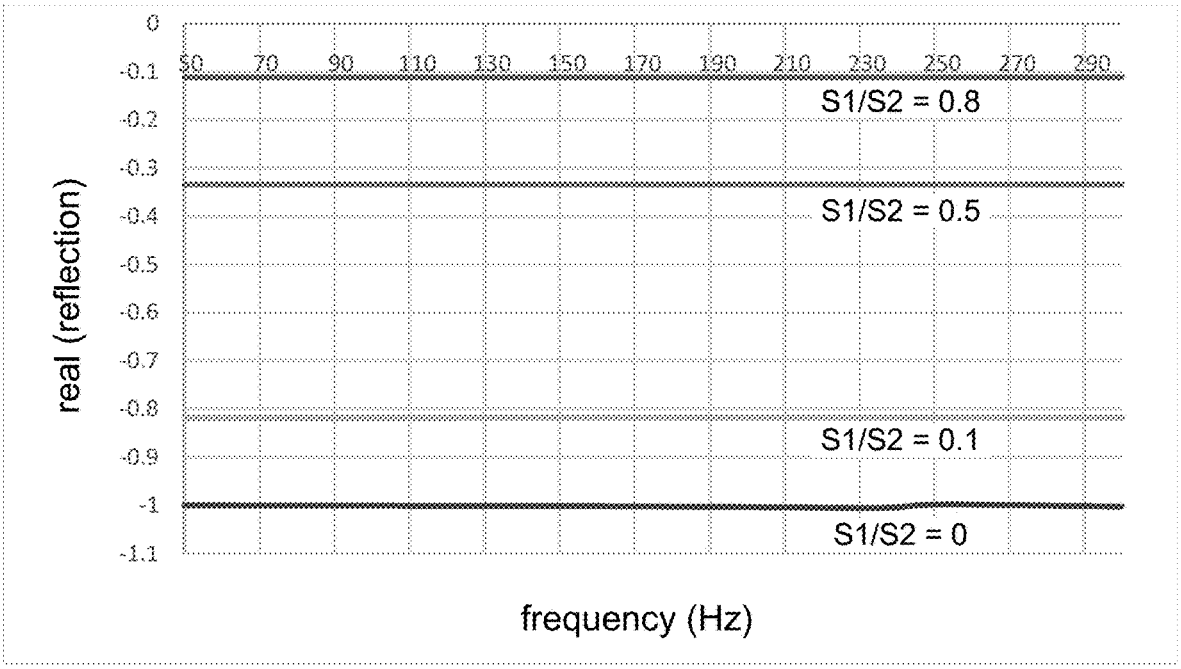

Another possible way to create a soft boundary condition is to make use of the sudden change in the cross-section area. FIGS. 5A-5C show a simulation from a change in cross-section of a tube. FIG. 5A is a schematic depiction of a change in a back tube. FIG. 5B is a schematic depiction of a change in the cross-sectional area of the sidewall. FIG. 5C is a graphic result showing, from top to bottom:

$S1/S2=0.8$ $S1/S2=0.5$ $S1/S2=0.1$ $S1/S2=0$

The depiction of FIG. 5C shows simulation results on the real part of the reflection coefficient with different area change.

A change in cross-section area as shown FIG. 5A can create a reflection governed by:

$$R = \frac{S1 - S2}{S1 + S2}, \tag{4}$$

where S1 and S2 are the cross-sectional areas of the front and back tube respectively.

It is noted that when S2 is bigger than S1, reflection R is negative, implying a partial soft boundary condition. In the extreme case where S2 equals infinity, reflection coefficient is −1, which corresponds to an ideal soft boundary condition.

Looking at the interface of the front and back tube in FIG. 5A, volume conservation (S1)(v1)=(S2)(v2) should always holds, where V1 and V2 represents normal velocity on the two sides. Given that creating a soft boundary on the interface implies a velocity anti-node (maximum), V1 is much larger than V2. The result is that the normal velocity is discontinuous and velocity components in other directions would be created. To explain this, consider the change in number of states of the system. By definition, the number of states, which is characterized by the wave vector of a wave, can be calculated by volume*(density of states).

The density of states depends on material which in our case is the same in the front and back tube. Therefore, it is clear that when a wave passes through the interface, the sudden increase in volume would result in increase of number of states. Since the magnitude of the wave vector is fixed by the frequency of the wave, the direction of the wave defines a state. The increase of number of states corresponds to more available propagation direction.

The advantage of utilizing the area change is that the soft boundary effect is independent of frequency. This means once the condition is reached, the effect can be very broad in band and can be effective to very low frequency range. Simulation results are shown in FIG. 5C to demonstrate the soft boundary effect with different area change.

The configuration shown in FIG. 5A has the disadvantage in that it is not always a practical construction, since a hard wall is usually required for forming structures or supports. Since alignment of the incident wave with the open space interface is not necessary for low frequencies, one obtains the opening opens on the sidewalls as illustrated in FIG. 5B. With the same area changes, simulation shows that the configuration in FIGS. 5A and 5B share the same result as shown in FIG. 5C. While the sidewall opening gives a possibility to form a very thin soft boundary plate, we have to consider the accessibility to the open space of each unit. Consider the Darcy's Law given by:

$$Q=-\kappa/\eta L\Delta P(\omega) \tag{5}$$

where Q is in unit of velocity of (oscillating) air flow,

κ is permeability which has the unit of area,

η is the air viscosity, L is the total distance to the interface with open space, and ΔP is the oscillating (at angular frequency) pressure difference across L.

For sound in air, $$\frac{1}{\rho v} = \frac{1}{1.2\ \text{kg/m}^3 \times 343\ \text{m/s}} = 2.4\times10^{-3}\,\text{m}^2/\text{kg}\cdot\text{sec},$$

where ρ and v is the density and sound velocity of air. This suggests that the coefficient $$\frac{n}{\eta L}$$

in (5) has to be larger than $2.4\times10^{-3}$ $m^2$/kg·sec in order to have sufficient air flow for accessing the open space.

Given that sound represents oscillating modulations of pressure, there is also the consideration of viscous boundary layer in Darcy's law, which can be presented as:

$$l=\sqrt{(\eta/\rho\omega)} \tag{6}$$

The transverse dimension of the pathway connecting the unit to the open area should not be smaller than the 2l.

By creating an area change on the sidewalls, we can not only utilize the soft boundary condition, but also turns the sound wave by 90° so that the sound is "extincted". Consider the system as shown in FIG. 5B, when the sound is turned by 90°, sound would not be able to reflect back to the front tube. This effect can significantly lower the sound level inside the front tube by avoiding back reflection. Taking advantage of the relatively large area in the back tube, it is possible to also absorb most of the transmitted sound easily by multiple scattering in the lateral direction; e.g., by placing some absorbing materials along the lateral propagating direction.

Figure 6A:
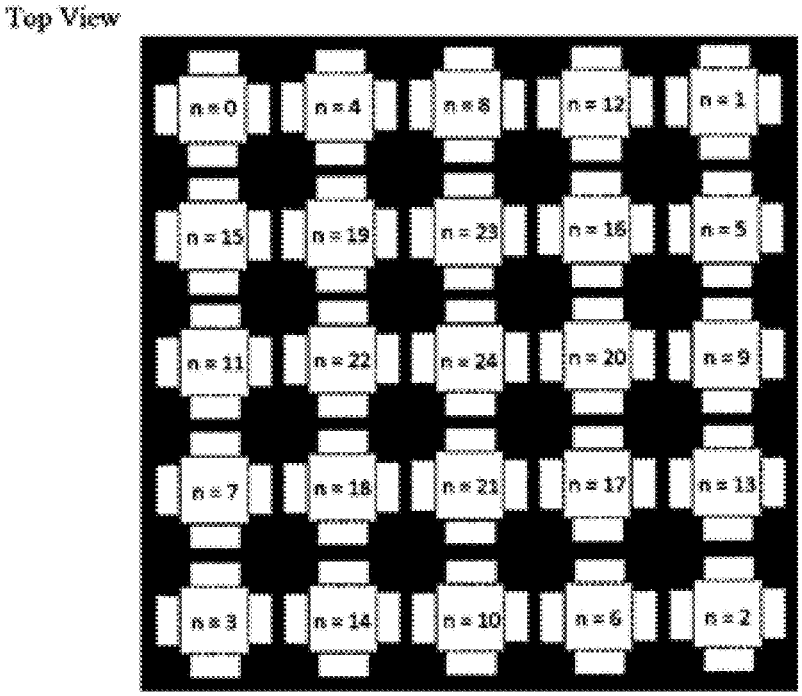
FIGS. 6A and 6B are schematic diagrams showing a top view (FIG. 6A) and a side cross-sectional view (FIG. 6B) of a soft boundary plate.
Figure 6B:
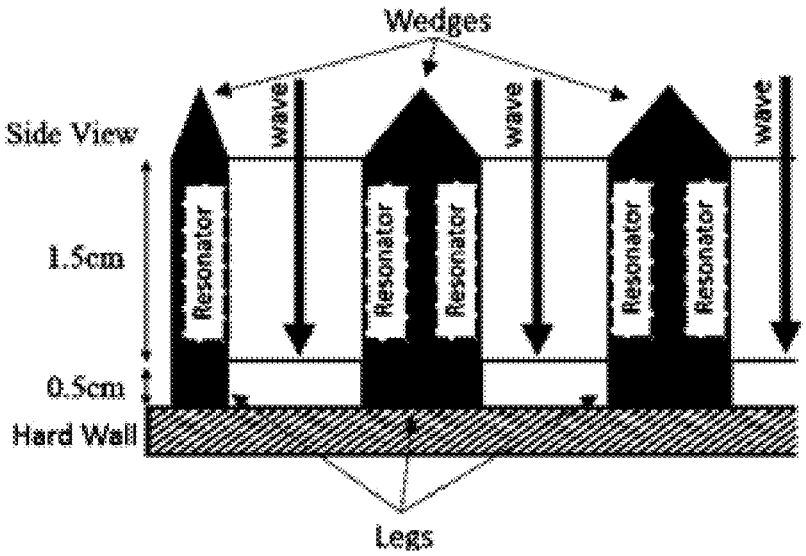

FIGS. 6A and 6B are schematic diagrams showing a top view (FIG. 6A) and a side cross-sectional view (FIG. 6B), showing the overall geometric configuration of an acoustic soft boundary plate. The depiction is of a 5 by 5 grid with 4 resonators mounted on the sidewalls of a unit. Resonators in each unit correspond to different resonance frequencies $f_n$ that is calculated by Equation (3). The "n" labeled in FIG. 6A corresponds to "n" in Equation (3) which shows the orientation of the resonance frequencies. The resonators with the lowest resonance frequency are put at the corner and edges while higher order resonators are located in the center of the plate. On the other hand, the side view of the plate shows that the resonators are sandwiched by wedges and legs. The function of the wedges is for enhancing the scattering effect and the leg can keep the plate 0.5 cm above hard wall so that the entire system is ventilated. The dimension of the plate can be 10 cm in both length and width, and the total thickness in this non-limiting example can be 2 cm.

Figure 7A:
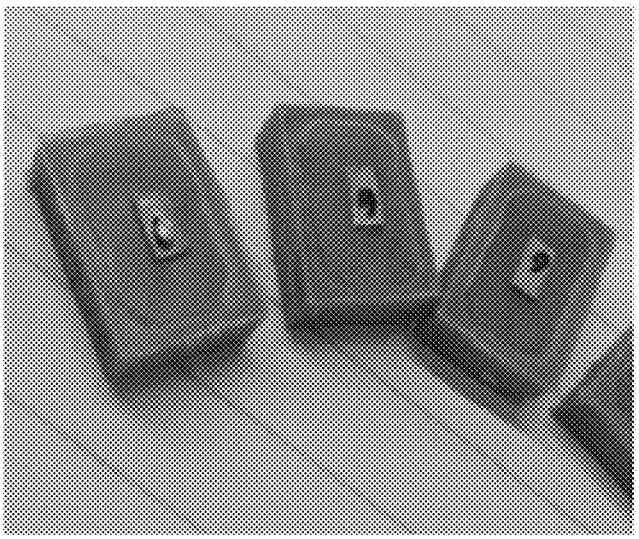
FIGS. 7A-7C are depictions of different types of resonators.
Figure 7B:
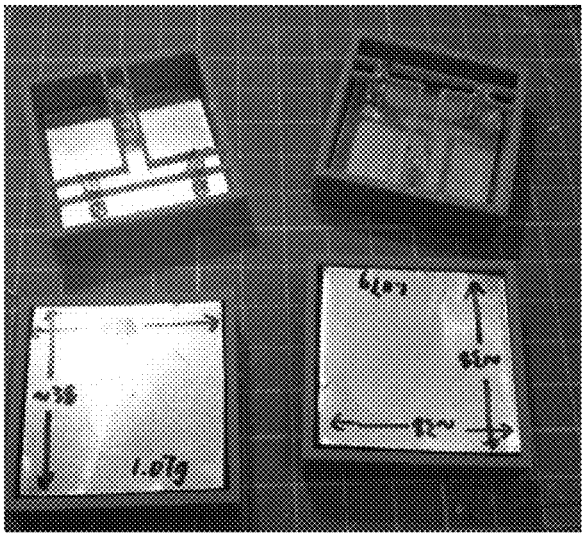
Figure 7C:
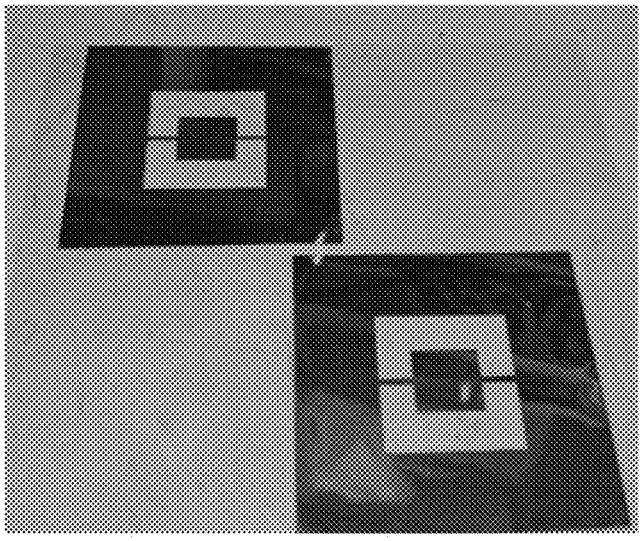

There are various choices for the resonators. FIGS. 7A-7C are depictions of different types of resonators. FIG. 7A shows hybrid membrane resonators. FIG. 7B shows spring mass resonators. FIG. 7C shows flexural resonators.

Simulation and Experimental Results

Figure 8A:
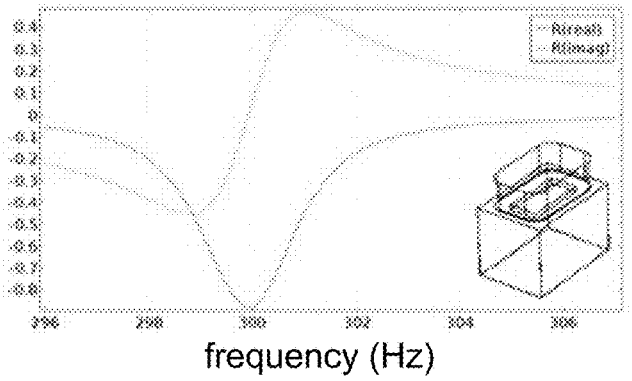
FIGS. 8A-8D are graphic depictions of COMSOL simulation results.
Figure 8B:
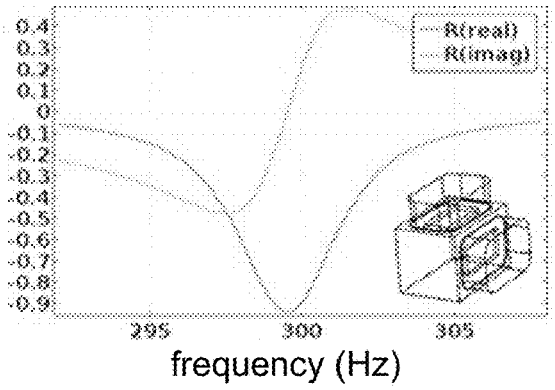
Figure 8C:
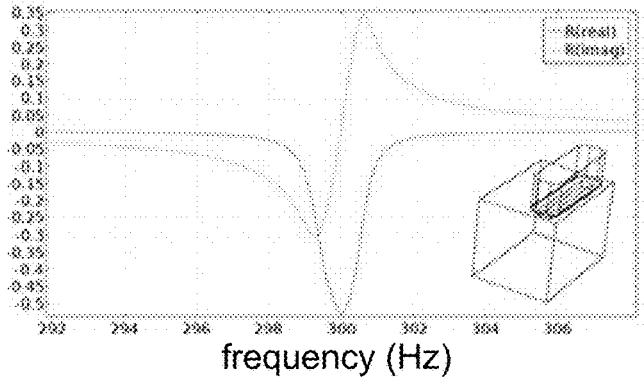
Figure 8D:
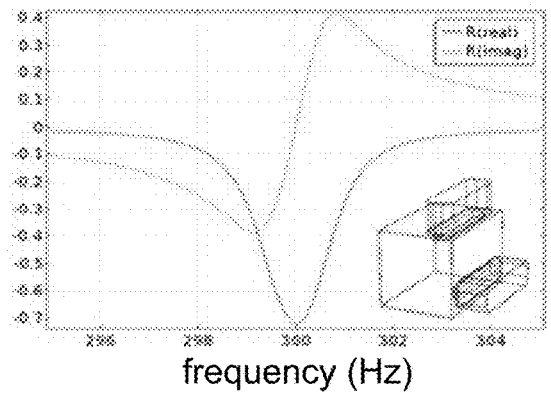

FIGS. 8A-8D are graphic depictions of COMSOL simulation results. FIG. 8A shows the results for a unit with a single large sidewall cavity. FIG. 8B shows the results for a unit with two large sidewall cavities. FIG. 8C shows the results for a unit with a single smaller sidewall cavity. FIG. 8D shows the results for a unit with two smaller sidewall cavities. In the charts, the lines starting at slightly higher values, and extending to a dip at the bottoms of the respective charts represent the real part of the reflectance. The lines starting at slightly lower values, and extending to a peak at the tops of the respective charts represent the imaginary part.

These COMSOL simulation results show the effect of using hybrid membrane resonators as an illustration of the soft boundary effect. Hybrid membrane resonator is a sidewall cavity covered by a decorated membrane resonator. By changing the mass and initial tension of the membrane, the resonance frequency can be controlled. An accurate prediction of the resonance frequency may be obtained by using the finite element COMSOL code. Two types of hybrid membrane resonators which have dimension 1.3 cm (length)×0.8 cm (width)×0.4 cm (depth), and 1.3 cm (length)×0.35 cm (width)×0.4 cm (depth) are modeled.

Applying 1.5 Pa initial tension to the membrane, we can achieve resonance frequency at 299.5 Hz with R=−0.87 for a single large sidewall cavity. By placing two identical large sidewall cavity resonators in a same unit, it is possible to achieve a (similar) resonance frequency at 299.6 Hz with R=−0.94. Similarly, it is possible to achieve a resonance frequency at 300 Hz, with R=−0.53 for a unit with one small sidewall cavity; and for a unit with two small sidewall cavities, it is possible to achieve a resonance frequency at 200 Hz with R=−0.73. FIGS. 8A-8D show the result of the simulation for both the large and small cavities.

Figure 9A:
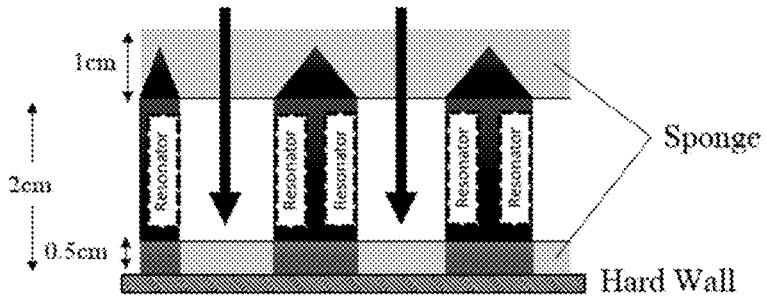
FIGS. 9A and 9B are a graphic depiction showing COMSOL simulation results.
Figure 9B:
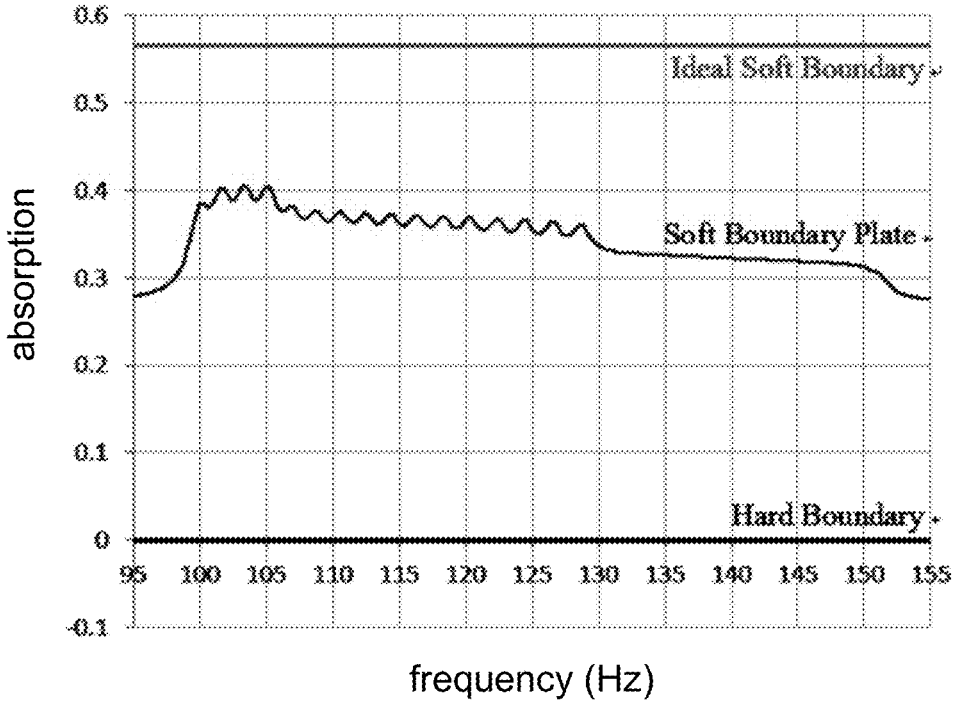

FIGS. 9A and 9B are a graphic depiction showing COMSOL simulation results. FIG. 9A is a schematic diagram of a 4 by 4 boundary plate used in the simulation. FIG. 9B is the graphic depiction of the simulation, showing absorption vs. frequency. As a non-limiting example, a simulation was carried out on a 4 by 4 soft boundary plate, targeting frequency ranging from 100 Hz to 150 Hz. Within each unit, 4 large hybrid membrane resonators with the same designed resonance frequency were mounted on the sidewalls. The plate was sandwiched by a 1 cm and 0.5 cm sponge on top and at the bottom as illustrated in FIG. 9A. FIG. 9B shows the absorption performance of the soft boundary plate as well as the performance of an ideal soft and a hard boundary covered by the same thickness of sponge.

Comparing the performance between hard boundary and soft boundary plate, it is clear that with the same thickness of sponge, soft boundary plate can perform much better. It is noted that at the low frequency regime as shown in FIG. 9B, the enhancement in absorption, when compared to the same thin acoustic sponge place against a hard wall, can be an order of magnitude or more over a broad frequency range. It is characteristic of the soft boundary plate that very high absorption, e.g., more than 90%, cannot be achieved with such a thin acoustic sponge layer.

EXAMPLES

Figure 10A:
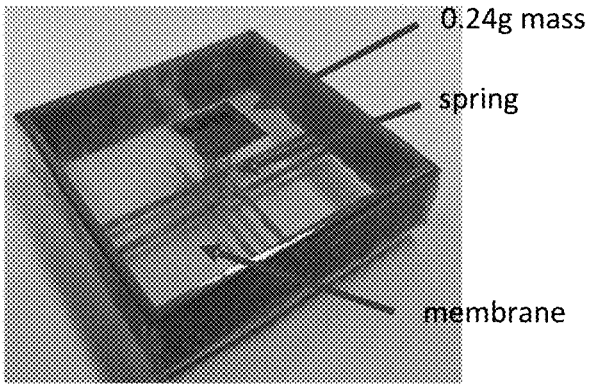
FIGS. 10A-10C show the effects of resonators mounted on sidewalls.
Figure 10B:
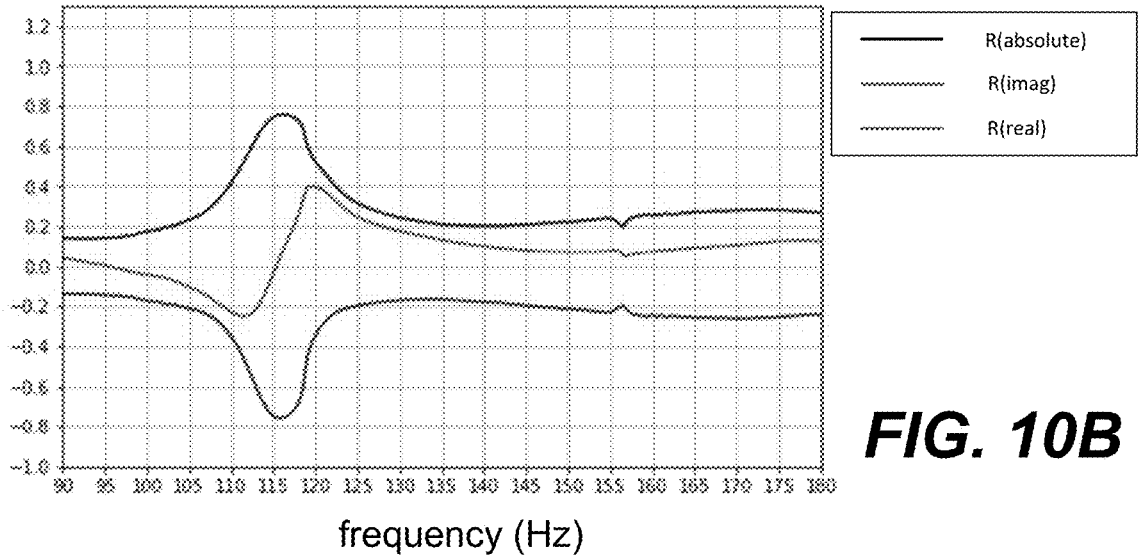
Figure 10C:
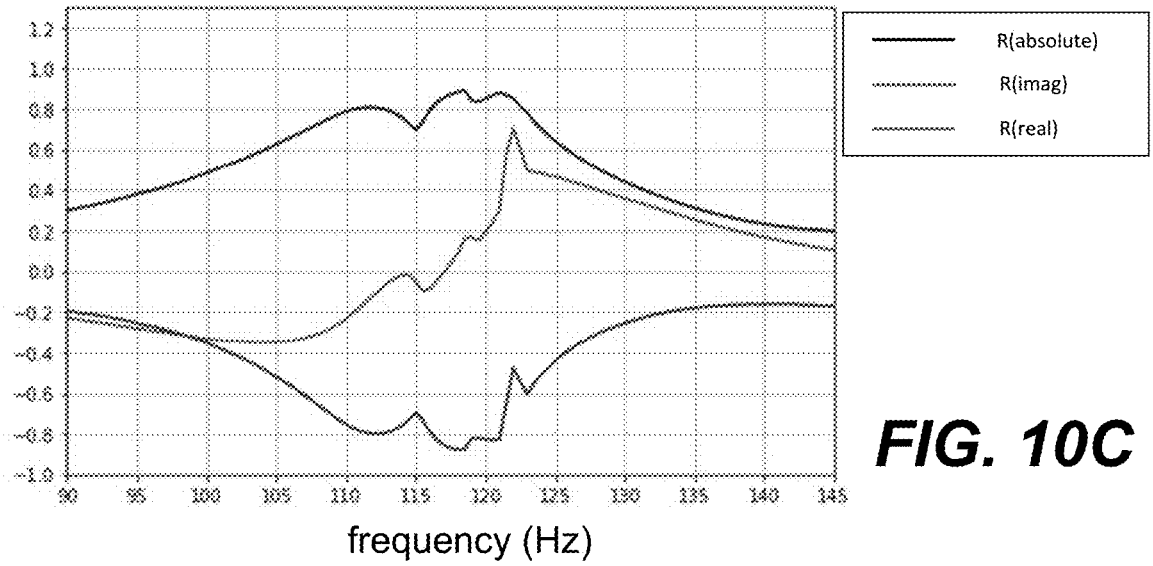

FIGS. 10A-10C show the effects of resonators mounted on sidewalls. FIG. 10A is an image of a resonator. FIG. 10B is a graphic representation of the reflection coefficient at different frequencies when one resonator is mounted on the sidewalls. FIG. 10C is a graphic representation of the reflection coefficient at different frequencies when three resonators are mounted on the sidewalls.

The depicted sample is a combination of a decorated membrane resonator and a spring mass resonator as shown in FIG. 10A. The dimension of the tested sample was 4.4 cm (length)×4.4 cm (width)×1.1 cm (depth). A 1 cm by 1 cm metal plate with a weight of 0.24 g was placed in the center of the membrane. A spring was attached to the membrane and located immediately under metal plate. By placing one resonator on one of the sidewalls, it was possible to achieve R=−0.74 at around 124 Hz as illustrated in FIG. 10B. Further placing two more resonators on the other two sidewalls, three reflection peaks with amplitude between −0.8 and −0.9 are realized between 110 Hz to 123 Hz, shown in FIG. 10C. The experimental results show excellent agreement with the simulation result shown in FIG. 10B, and at the same time demonstrates the feasibility of making a soft boundary plate with resonators.

Figure 11A:
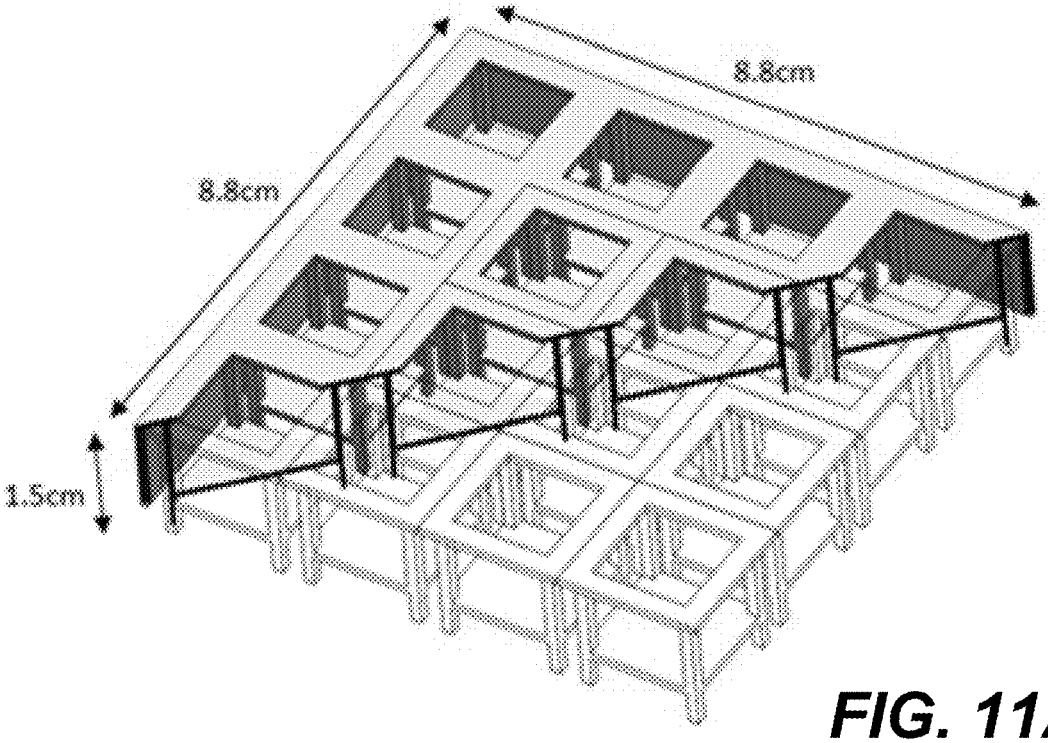
FIGS. 11A and 11B are schematic diagrams of a 4 by 4 sample and a single unit.
Figure 11B:
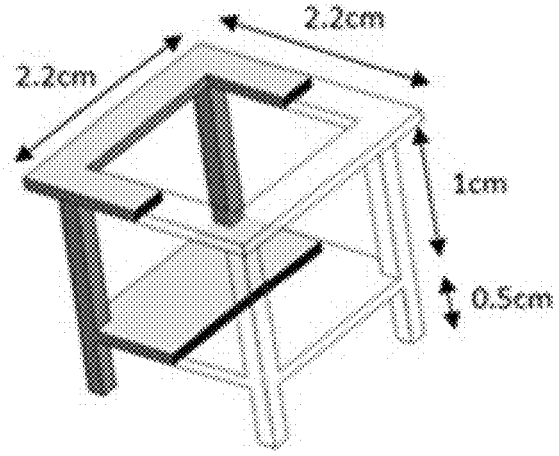

FIGS. 11A and 11B are schematic diagrams of a 4 by 4 sample and a single unit, presenting one possible physical realization that makes use of the cross-sectional area change to achieve the soft boundary condition. FIG. 11A shows the design of a 4 by 4 plate and FIG. 11B shows the configuration of a single unit. The principle behind the design is to create an area change by using the opened sidewalls in each. When the wave turns and passes the sidewalls in each unit, the spaces between each unit would guide the wave to the back or bottom part of the plate where all units are connected and opened to the outside space.

By opening the sidewalls of each unit such that they are connected to the open space, incident sound waves would encounter an increase of cross-sectional area, which results in a soft boundary condition. By placing an absorbing material on the device, the absorption performance is enhanced for low frequency waves, in part due to the soft boundary condition. At the same time, given that the air can pass through the device with 90° directional shift, sound waves would be scattered away. The 90° directional shift is at least partially the result of a closed or restricted backwall. This mixture of enhanced absorption and the 90° directional shift, resulting in scattering of the sound waves, is described as the extinction effect, which can help reduce the sound being reflected to the main concerned area.

The lateral dimension of a single unit can be 2.2 cm by 2.2 cm so that the dimension of a 4 by 4 plate can be 8.8 cm in both length and width. The total thickness of the plate can be 1.5 cm with 1 cm serving as the middle part and 0.5 cm serving as the back or bottom part. It is noted that the dimension of each unit can be smaller or larger to fit the practical situation. Also, to allow the unit gain access to the open space, a periodic open condition can be made on the backing of the plate.

Figure 12A:
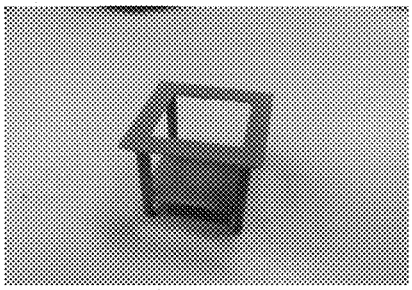
FIGS. 12A-E show simulation results of different 2.5 cm and 5 cm sponges.
Figure 12B:
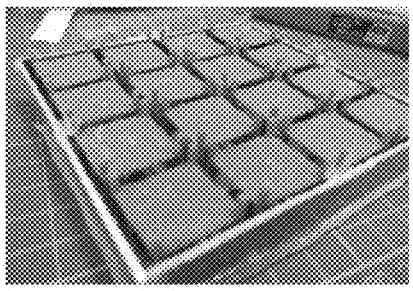
Figure 12C:
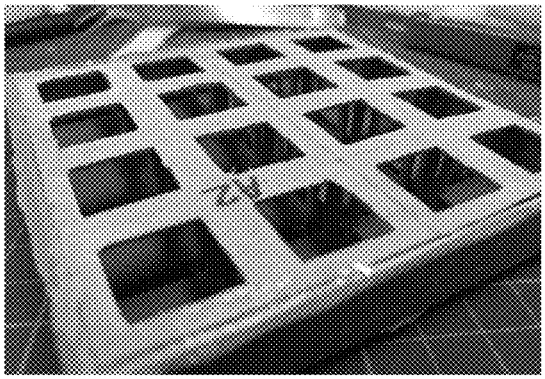
Figure 12D:
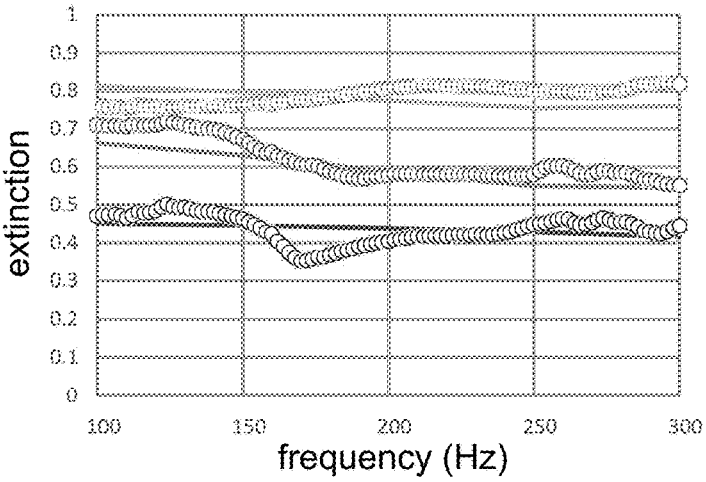

FIGS. 12A-E show simulation results of different 2.5 cm and 5 cm sponges, called type I and type II, respectively. The type I and II sponges have different absorption performances, which provides data on the performance resulting from different types of sound absorbing materials. FIGS. 12A-12C are photo image of a single unit (FIG. 12A) and bottom and top views of 4 by 4 plate (FIGS. 12B and 12C, respectively). FIG. 12D is a graphic depiction of an experimental and simulation result of the soft plate sample covered by a type I sponge which is 2.5 cm depicted in the lower plots (blue line and circles) and 5 cm depicted in the middle plots (orange line and circles). The upper plots (yellow line and circles) represent the simulated and experimental absorption performance of the same soft plate sample covered by a type II sponge which is 3 cm thick. It can be seen from this depiction that the type II sponge is much more absorbing.

Figure 12E:
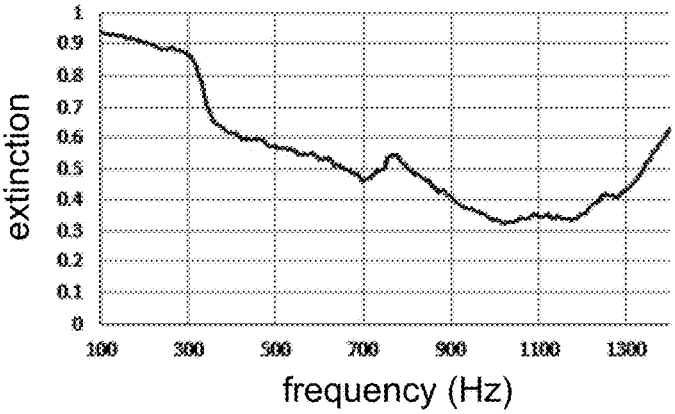

FIG. 12E graphically depicts the absorption spectrum of the soft plate sample covered by a 1 cm thick type II sponge. This shows another set of measurement result with a broader measured frequency range, where the plate was covered by a 1 cm thick type II sponge. As can be seen, the absorption spectrum shows a gradual drop as the frequency increases. The reason for this is that the absorption plotted in the graph is not purely the effect of the absorption from the sponge, but also the effect of scattering into the lateral direction. As discussed in the previous section, the proper description of the over 90% disappearance of reflected energy should be "extinction", which is a combination of absorption plus scattering into the lateral direction. When a wave is guided to travel in a direction that is perpendicular to its original direction, it is impossible for the wave to be reflected back. The combination of the absorption and 90° scattering effect is responsible for the over 90% absorption spectrum in both FIG. 12D and at low frequencies. It can be seen that together with the two effects we can achieve a very high extinction performance, especially at low frequencies, i.e., below 300 Hz.

CONCLUSION

It will be understood that many additional changes in the details, materials, steps and arrangement of parts, which have been herein described and illustrated to explain the nature of the subject matter, may be made by those skilled in the art within the principle and scope of the invention as expressed in the appended claims.

What is claimed is:

1. A soft boundary structure comprising:

a resonator structure capable of receiving sound or vibration, establishing resonances coupled with received sound or vibration, and creating a reflection with a pi phase factor;

a structure having a restricted top plate, a plurality of open sidewalls and a restricted backwall, the structure configured to create an area change by using the open sidewalls; and a soft boundary located on or closely adjacent the resonator structure, the soft boundary cooperating with the resonator structure to attenuate the sound or vibration, wherein the open sidewalls cause incident sound waves engaging the structure to turn and pass at least a subset of the plurality of sidewalls, and wherein incident sound waves encounter an increase of cross-sectional area, which results in a soft boundary condition, effecting constructive interference between reflected and original waves.

2. The sound absorbing structure of claim 1, wherein the soft boundary comprises an acoustic sponge comprising porous reticulated sound absorbing material.

3. The sound absorbing structure of claim 1, wherein the soft boundary comprises sound absorbing material placed on a hard wall boundary of the resonator structure.

4. The sound absorbing structure of claim 1, wherein the resonator structure comprises sidewall resonators, wherein the sidewall resonators achieve sound extinction through scattering to a different direction from an incident direction through absorption and/or scattering effects.

5. The sound absorbing structure of claim 1, wherein the resonator structure comprises sidewall resonators, wherein the sidewall resonators achieve sound extinction through scattering substantially 90° from an incident direction through absorption and/or scattering effects.

6. The sound absorbing structure of claim 1, further comprising:

the soft boundary comprising a sound absorbing material positioned in front of the resonator structure in a direction incident to received sound, wherein the resonator structure comprises sidewall resonators, wherein the sidewall resonators cause sound or vibration scattering to a different direction from an incident direction through absorption and/or scattering effects, whereby the combination of the soft boundary and the sidewall resonators provide a sound extinguishing effect.

7. The sound absorbing structure of claim 1, wherein the structure causes the incident sound waves to turn, resulting in an extinction effect to reduce reflected sound.

8. The sound absorbing structure of claim 1, wherein the sound absorbing structure receives sound or vibration from an external dipolar source, by said effecting constructive interference between reflected and original waves from the external dipolar source.

9. The sound absorbing structure of claim 1, wherein the sound absorbing structure receives sound or vibration from an external dipolar source, by said effecting constructive interference between reflected and original waves.

10. A method of sound absorption comprising:

receiving sound or vibration with a resonator structure;

using the resonator structure to create a reflection with a pi phase factor;

providing a restricted top plate, a plurality of open sidewalls and a restricted backwall to create an area change by using the open sidewalls;

establishing a resonance of the received sound or vibration, and providing diminished reflection, through absorption or scattering effects; and using a soft boundary located on or closely adjacent the resonator structure, wherein the soft boundary cooperates with the resonator structure to attenuate the sound or vibration, wherein the open sidewalls cause incident sound waves engaging the structure to turn and pass at least a subset of the plurality of sidewalls, and wherein incident sound waves encounter an increase of cross-sectional area, which results in a soft boundary condition, effecting constructive interference between reflected and original waves.

11. The method of sound absorption of claim 10, further comprising:

providing, as part of the soft boundary, an acoustic sponge comprising porous reticulated sound absorbing material.

12. The method of sound absorption of claim 10, further comprising:

providing, as part of the soft boundary, sound absorbing material; and placing the sound absorbing material on a hard wall boundary of the resonator structure.

13. The method of sound absorption of claim 10, further comprising:

providing, as at least a part of the resonator structure, sidewall resonators, wherein the sidewall resonators achieve sound extinction through scattering to a different direction from an incident direction through absorption and/or scattering effects.

14. The method of sound absorption of claim 10, further comprising:

providing, as at least a part of the resonator structure, sidewall resonators, wherein the sidewall resonators achieve sound extinction through scattering to substantially 90° from an incident direction through absorption and/or scattering effects.

15. The method of sound absorption of claim 10, wherein the structure causes the incident sound waves to turn, resulting in an extinction effect to reduce reflected sound.

16. The method of sound absorption of claim 10, further comprising:

the soft boundary comprising a sound absorbing material positioned in front of the resonator structure in a direction incident to received sound; and, using sidewall resonators as at least part of the resonator structure, wherein the sidewall resonators cause sound or vibration scattering to a different direction from an incident direction through absorption and/or scattering effects, whereby the combination of the soft boundary and the sidewall resonators provide a sound extinguishing effect.

17. The method of sound absorption of claim 10, comprising receiving sound or vibration from an externally-generated dipolar source, by said effecting constructive interference between reflected and original waves from the externally-generated dipolar source.

18. The method of sound absorption of claim 10, comprising receiving sound or vibration from a dipolar sound or vibration source, by said effecting constructive interference between reflected and original waves.

19. A sound absorbing structure comprising:

a resonator structure for receiving sound or vibration;

means to create a reflection with a pi phase factor;

means for establishing a resonance of the received sound or vibration and for providing diminished reflection, through absorption or scattering effects a structure having a restricted top plate, a plurality of open sidewalls and a restricted backwall, the structure configured to create an area change by using the open sidewalls; and a soft boundary located on or closely adjacent the resonator structure, wherein the soft boundary cooperates with the resonator structure to attenuate the sound or vibration, wherein the open sidewalls cause incident sound waves engaging the structure to turn and pass at least a subset of the plurality of sidewalls, and wherein incident sound waves encounter an increase of cross-sectional area, which results in a soft boundary condition, effecting constructive interference between reflected and original waves.

20. The sound absorbing structure of claim 19, further comprising:

the soft boundary comprising an acoustic sponge comprising porous reticulated sound absorbing material.

21. The sound absorbing structure of claim 19, further comprising:

the soft boundary comprising sound absorbing material placed on a hard wall boundary of the resonator structure.

22. The sound absorbing structure of claim 19, further comprising:

the resonator structure comprising sidewall resonators, wherein the sidewall resonators achieve sound extinction through scattering to a different direction from an incident direction through absorption and/or scattering effects.

23. The sound absorbing structure of claim 19, further comprising:

the resonator structure comprising sidewall resonators, wherein the sidewall resonators achieve sound extinction through scattering to substantially 90° from an incident direction through absorption and/or scattering effects.

24. The sound absorbing structure of claim 19, wherein the structure causes the incident sound waves to turn, resulting in an extinction effect to reduce reflected sound.

25. The sound absorbing structure of claim 19, further comprising:

the soft boundary comprising a sound absorbing material positioned in front of the resonator structure in a direction incident to received sound; and, the resonator structure comprising sidewall resonators, wherein the sidewall resonators cause sound or vibration scattering to a different direction from an incident direction through absorption and/or scattering effects, whereby the combination of the soft boundary and the sidewall resonators provide a sound extinguishing effect.

26. The sound absorbing structure of claim 19, wherein the sound absorbing structure receives sound or vibration from an external dipolar source, by said effecting constructive interference between reflected and original waves.

* * * * *